US008981944B2

(12) United States Patent
Jeanneteau et al.

(10) Patent No.: US 8,981,944 B2
(45) Date of Patent: Mar. 17, 2015

(54) INTERACTION DEVICE

(75) Inventors: Laurent Jeanneteau, Compiegne (FR); Thibaut Rigolle, Forli (FR); Massimo Nostro, Forli (IT); Arturo Negretti, Castrocaro Terme (IT); Andrea Rossi, Ravenna (IT); Andrea Zangoli, Santarcangelo di Romagna (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 1143 days.

(21) Appl. No.: 12/989,812

(22) PCT Filed: May 20, 2009

(86) PCT No.: PCT/EP2009/003590

§ 371 (c)(1),
(2), (4) Date: Apr. 6, 2011

(87) PCT Pub. No.: WO2009/152912

PCT Pub. Date: Dec. 23, 2009

(65) Prior Publication Data

US 2011/0187539 A1 Aug. 4, 2011

(30) Foreign Application Priority Data

May 30, 2008 (EP) ..... 08009913

(51) Int. Cl.
*G08B 17/00* (2006.01)
*F24C 7/08* (2006.01)
*H05B 6/12* (2006.01)

(52) U.S. Cl.
CPC . *F24C 7/082* (2013.01); *H05B 6/12* (2013.01)
USPC ..... 340/584; 340/643; 219/446.1

(58) Field of Classification Search
USPC ..... 340/584, 643; 219/446.1; 345/174, 173
See application file for complete search history.

(56) References Cited

U.S. PATENT DOCUMENTS 6,111,228 A 8/2000 Berkcan et al.

FOREIGN PATENT DOCUMENTS

| | | |
|---|---|---|
| DE | 19960495 | 9/2001 |
| EP | 1109424 | 6/2001 |
| EP | 1303169 | 4/2003 |

OTHER PUBLICATIONS

International Search Report for PCT/EP2009/003590, dated Oct. 15, 2010, 2 pages.

*Primary Examiner* — Steven Lim
*Assistant Examiner* — Hongmin Fan
(74) *Attorney, Agent, or Firm* — Pearne & Gordon LLP

(57) ABSTRACT

The invention relates to an interaction device (1), comprising a) a first input unit (20) with a first sensitive surface, especially a touch display, and a first sensor unit, b) a second input unit (2-12) with a second sensitive surface and a second sensor unit, c) wherein the second input unit (2-12) is used for protection of the first input unit (20), especially against overheating and/or mechanical damaging. Furthermore, the invention relates to a glass ceramic hob (22), especially induction cooking hob, with an interaction device (1) according to the invention a) wherein preferably the interaction device (1) is arranged in a side and/or edge area of the glass ceramic hob and/or arranged at the lower surface of the glass ceramic hob (22) and/or b) wherein preferably the glass ceramic hob comprises a fan for ventilation. Furthermore, the invention relates to a method for protection of an input unit, preferably for an interaction device and/or a glass ceramic hob according to the invention, comprising a) a first input unit (20) with a first sensitive surface, especially a touch display, and a first sensor unit, b) a second input unit (2-11) with a second sensitive surface and a second sensor unit, c) wherein the second input unit protects the first input unit, d) wherein after an input has been detected by the second input unit, especially after a preselected threshold value has been exceeded, e) the input value is compared with at least one preselected threshold value, f) wherein the at least one threshold value is preferably larger than a threshold value generated by the press or the touch of a finger, g) wherein after exceeding the at least one threshold value, g1) the first input unit (20) is turned off and/or g2) the heating energy for the glass ceramic hob, especially the induction current, is turned off to decrease the temperature and/or g3) an alarm is generated, especially an optical or acoustical alarm, to warn the operator and/or g4) the speed of the fan is increased to decrease the temperature.

17 Claims, 3 Drawing Sheets

INTERACTION DEVICE

The invention relates to an interaction device comprising a first input unit with a first sensitive surface, especially a touch display, and a first sensor unit.

Input units with sensitive surfaces, especially touch displays, are becoming more and more popular. However, often times the surfaces are sensitive with respect to hot items, for example hot pans, as this can cause an aging of the sensitive surfaces or even a destruction of the sensitive surfaces.

Therefore, it is an object of the invention to find a way to protect the sensitive surfaces in a way which is producible at least relatively easy and cheap.

This object is solved by an interaction device according to claim 1, a glass ceramic hob according to claim 8 and a method for protection according to claim 9. Advantageous embodiments are described in the dependent claims.

According to claim 1, the interaction device comprises a) a first input unit with a first sensitive surface, especially a touch display, and a first sensor unit, b) a second input unit with a second sensitive surface and a second sensor unit, c) wherein the second input unit is used for protection of the first input unit, especially against overheating and/or mechanical damaging.

The interaction device according to the invention can be implemented in an at least relatively easy way. According to the invention, at least two input units are provided. By using the second input unit for protection of the first input unit, an effective protection of the first input unit can be achieved.

According to an advantageous embodiment, the interaction device comprises a) at least one detection unit and at least one information processing unit, b) wherein the first input unit and the second input unit use at least substantially the same or the same type of detection unit and/or c) wherein the first input unit and the second input unit use at least substantially the same or the same type of information processing unit.

The interaction device according to this advantageous embodiment can be implemented in an at least relatively easy way, as an existing detection unit and/or an existing information processing unit can be used for both input units, while either the same units are used or at least units of the same or of a similar type can be used.

In a further advantageous embodiment, a) the first and/or the second input unit is/are arranged on or at a glass surface and/or b) the first and/or the second sensor unit is/are arranged on the one the side of the glass surface and actuated from the other side of the glass surface.

If the first and/or the second sensor unit is/are arranged on the one side of the glass surface and actuated from the other side of the glass surface, the protection of the input units can be improved.

In another advantageous embodiment, a) the first input unit is disengageable and/or b) an alarm, especially an acoustical and/or optical alarm, is generable and/or c) the interaction device is connected to a fan and the fan speed in increasable, after the detection of an input exceeding a predefined threshold value by the second input unit. The detection of an input exceeding a predefined threshold value by the second input unit can mean that a critical item is at or near the first input unit. The three different procedures according to this embodiment are advantageous possibilities to prevent a damaging of the first input unit when such a threshold value has been detected.

In an advantageous embodiment, a) the first input unit is activatable by fingers and/or b) the second input unit is activatable by items, especially metal objects, pots, pans, grills, forks, spoons, knifes, cookware, water, milk and/or damp clothes on or close to a defined area.

This means that the first input unit can work as a common input unit, whereas the second input unit can be operated by items which can damage the first input unit.

Preferably, a) the second input unit is arranged next to or around the first input unit and/or b) the second input unit is adapted to the form of the first input unit and/or c) the second input unit is connected with the first input unit by at least one connection, d) the second input unit has a rectangular, triangular, ellipsoid, lined, fork frame and/or comb shape and/or e) the second input is arranged with or without distance to the first input unit and/or f) at least one connection is arranged between the first input unit and the second input unit.

An appropriate arrangement of the second input unit with respect to the first input unit is a good measure to protect the first input unit in an effective way, as by an appropriate arrangement often times the potentially damaging items can be detected during approaching the first unit.

In an advantageous embodiment, a) the first and/or the second sensor unit comprises metal, especially aluminium, copper and/or nickel and/or is a capacitive sensor unit and/or b) the first and/or the second input unit comprise or work like sensor keys and/or c) the first input unit is formed at least substantially rectangular and/or d) the first input unit comprises sensor keys with a display, especially an LED-display, an LCD display or a TFT-display.

According to claim 8, the invention further comprises a glass ceramic hob, especially an induction cooking hob, with an interaction device according to one of the preceding claims, a) wherein preferably the interaction device is arranged in a side and/or edge area of the glass ceramic hob and/or arranged at the lower surface of the glass ceramic hob and/or b) wherein preferably the glass ceramic hob comprises a fan for ventilation.

If a glass ceramic hob with an interaction device is used, there is an at least relatively high risk that a hot pot or other hot items get close to the interaction device, especially if the interaction device is integrated into the surface of the glass ceramic hob. Therefore, a combination of a glass ceramic hob with an interaction device according to the invention can be very advantageous.

According to claim 9, the invention further comprises a method for protection of an input unit, preferably for an interaction device and/or a glass ceramic hob according to one of the preceding claims, comprising a) a first input unit with a first sensitive surface, especially a touch display, and a first sensor unit, b) a second input unit with a second sensitive surface and a second sensor unit, c) wherein the second input unit protects the first input unit, d) wherein after an input has been detected by the second input unit, especially after a preselected threshold value has been exceeded, e) the input value is compared with at least one preselected threshold value, f) wherein the at least one threshold value is preferably larger than a threshold value generated by the press or the touch of a finger, g) wherein after exceeding the at least one threshold value, g1) the first input unit is turned off and/or g2) the heating energy for the glass ceramic hob, especially the induction current, is turned off to decrease the temperature and/or g3) an alarm is generated, especially an optical or acoustical alarm, to warn the operator and/or g4) the speed of the fan is increased to decrease the temperature.

The use of different threshold values enables to use the same detection and/or information processing means for the first and the second input unit, so that processing of the input values is at least basically the same, only the threshold value is different.

Preferably, the second input unit detects when an item, especially a metal object, a pot, a pan, a grill, a fork, a spoon, cookware, water, milk and/or damp clothes is on or close to a defined area. Preferably, the detection is independent from the temperature. This makes it possible to detect also cold items which can also damage the first input unit, for example water, milk and/or damp clothes.

The invention will be now described in further details with references to the figures, in which FIG. 1 describes a system according to the invention integrated into a cooking plate, FIGS. 2 to 10 show different embodiments of the interaction device according to the invention and in which FIG. 11 shows a block diagram of the interaction device according to the invention.

FIG. 1 shows a glass ceramic hob 22 of an induction hob with a rectangular touch display 20 in the lower right corner. The touch display 20 is designed as an LED-, LCD or TFT-display and surrounded by an also rectangular protective area 2, which includes a sensor and will generate a cut-off of the glass ceramic hob 22 and/or an alarm signal as soon as it detects the presence of a potentially dangerous item, for example a hot pan or a hot pot 21 or an accumulation of water.

FIGS. 2 to 10 show different embodiments of the interaction device according to the invention, with a rectangular touch display 20.

In FIG. 2, the touch display 20 is surrounded rectangular by a protective area 3.

In FIG. 3, the protective area 4 is at least substantially square shaped and arranged adjacent to the upper side of the touch display 20.

In the embodiment according to FIG. 4, the protective area 5 is formed like a handle with two side parts, each along a straight line, and a connecting part connecting the side parts at their outer ends which is perpendicular with respect to the side parts.

The embodiment according to FIG. 5 shows a protective area 6, which protrudes away from the touch display 20 in a straight line and has a top part which is perpendicular to the straight line and protrudes parallel to the side of the touch display 20, where the top part has a length which is equal to the side length of the touch display 20.

Figure 1:
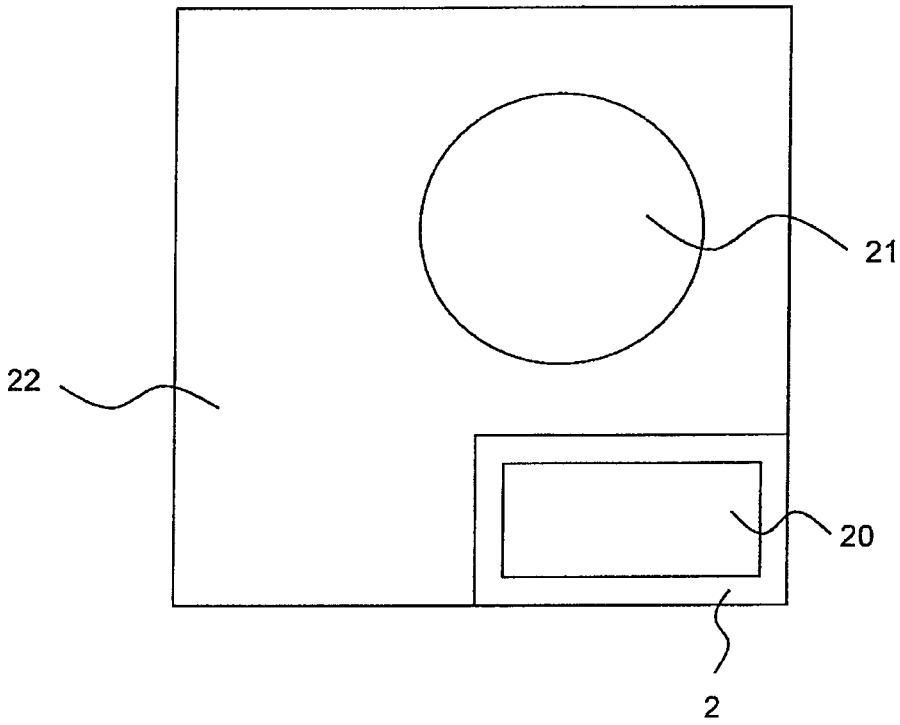
Figure 2:
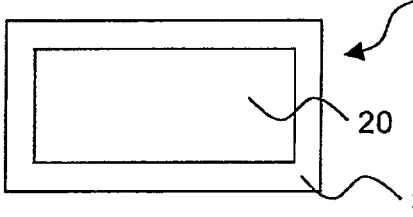
Figure 3:
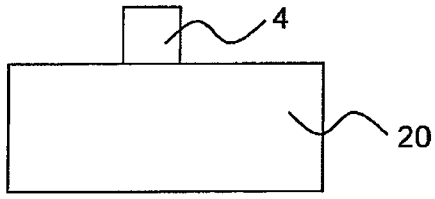
Figure 4:
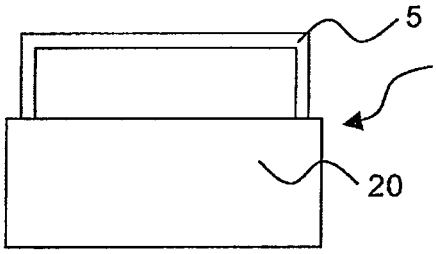
Figure 5:
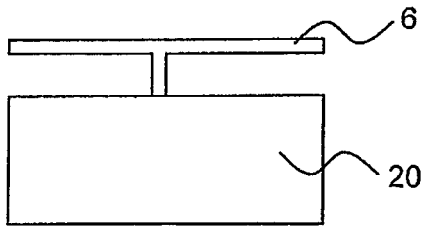
Figure 6:
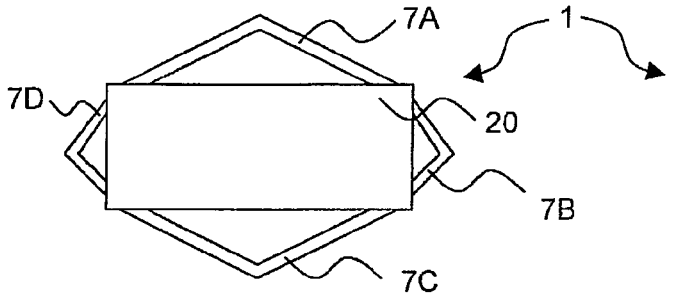
FIG. 6 shows another embodiment of the invention with four bended protective areas 7A to 7D, which extend along the four sides of the touch display 20, where the bend is in the centre of the protective areas 7A to 7D. Therefore, between the protective areas 7A to 7D and the sides of the touch display 20, isosceles triangles are arranged.
Figure 7:
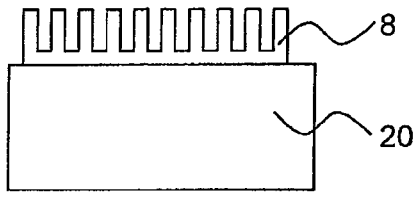
FIG. 7 shows a protective area 8 with a form similar to a comb with teeth protruding away from the touch display 20.
Figure 8:
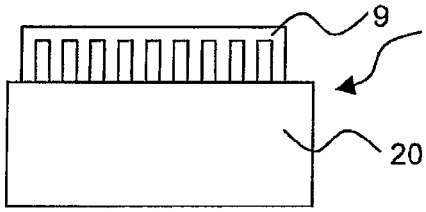

FIG. 8 shows another embodiment of the interaction device with a protective area 9 which is formed like a comb. However, in the embodiment according to FIG. 8, the teeth of the comb 9 are oriented towards the touch display 20.

Figure 9:
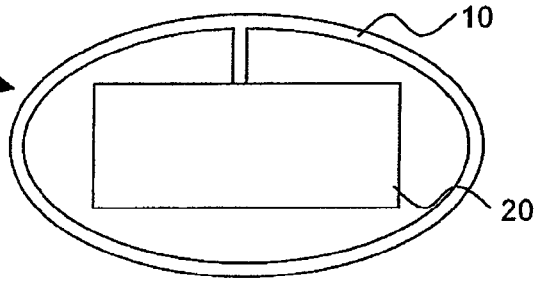

In FIG. 9, the protective area 10 is formed like an ellipse which is connected with the touch display 20 via a straight connection line.

Figure 10:
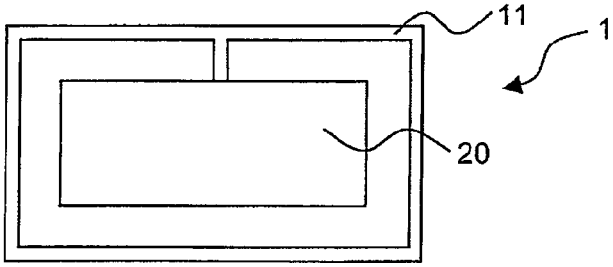

FIG. 10 shows another embodiment of the interaction device according to the invention, with a rectangular protective area 11, which is connected with the touch display 20 via a straight connection line.

Figure 11:
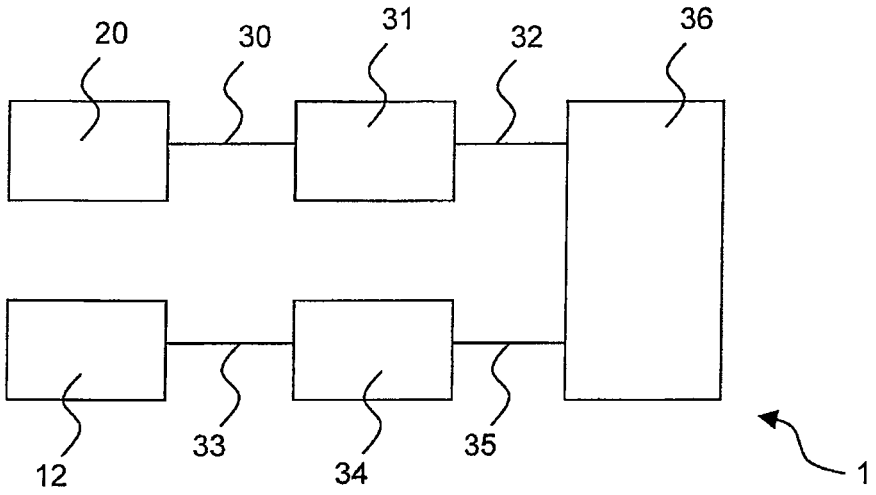

FIG. 11 shows a block diagram of the interaction device 1 according to invention. The sensor unit of the protective area 12 is connected with the detection unit 34 via a connection line 33, whereas the detection unit 34 is connected with an information processing unit 36 via a connecting line 35.

Similarly, the sensor unit of the touch display 20 is connected with a detection unit 31 via a connection line 30, and detection unit 31 is connected with the information processing unit 36 via a connecting line 32.

The sensor unit works as a capacitive sensor and can be made of metal, copper, aluminium, nickel or other materials.

After an input has been detected by the sensor unit of the protective area, especially after a preselected threshold value has been exceeded, the input value is compared with at least one preselected threshold value.

The threshold value is preferably larger than a threshold value generated by the press or the touch of a finger. Therefore, the same processing units can be used and no additional of different evaluation hardware and/or software is necessary.

When a pot or another item is detected, the system can either generate an alarm, especially by a visual, flashing display or any other colour means or an acoustical signal.

Furthermore, the system can cut off the power that is applied to a large pot or increase a cooling fan, especially of the glass ceramic hob 22, to a higher speed to prevent internal overheating.

LIST OF REFERENCE NUMERALS

1 interaction device
2-12 protective area
20 touch display
21 pot
22 glass ceramic hob
30, 32, 33, 35 connection lines
31, 34 detection units
36 information processing unit

The invention claimed is:

1. Interaction device (1), comprising a) a first input unit (20) with a first sensitive surface and a first sensor unit, b) a second input unit (2-12) with a second sensitive surface and a second sensor unit, c) wherein the second input unit (2-12) is used for protection of the first input unit (20) against overheating and/or mechanical damaging.

2. Interaction device according to claim 1, comprising a) at least one detection unit (31) and at least one information processing unit (36), b) wherein the first input unit (20) and the second input unit (2-12) use substantially the same or the same type of detection unit (31, 34) and/or c) wherein the first input unit (20) and the second input unit (2-12) use substantially the same or the same type of information processing unit (36).

3. Interaction device according to claim 1, a) wherein the first (20) and/or the second (2-12) input unit is/are arranged on or at a glass surface and/or b) wherein the first and/or the second sensor unit is/are arranged on the one side of the glass surface and actuated from the other side of the glass surface.

4. Interaction device according to claim 1, wherein a) the first input unit (20) is disengageable and/or b) an alarm, generable and/or c) the interaction device is connected to a fan and the fan speed is increasable, after a detection of an input exceeding a predefined threshold value by the second input unit (2-12).

5. Interaction device according to claim 1, a) wherein the first input unit (20) can be activated by fingers and/or b) wherein the second input unit (2-11) can be activated by items placed on or close to a defined area.

6. Interaction device according to claim 1, a) wherein the second input unit (2-11) is arranged next to or around the first input unit (20) and/or b) wherein the second input unit (2-11) is adapted to the form of the first input unit (20) and/or c) wherein the second input unit (2-11) is connected with the first input unit (20) by at least one connection, d) wherein the second input (2-12) unit has a rectangular, tri-angular, ellipsoid, lined, fork frame and/or comb shape and/or e) wherein the second input (2-12) is arranged with or without distance to the first input unit and/or f) wherein at least one connection is arranged between the first input unit (20) and the second input unit (2-12).

7. Interaction device according to claim 1, a) wherein the first and/or the second sensor unit comprises metal, b) wherein the first (20) and/or the second (2-12) input unit comprise or work like sensor keys and/or c) wherein the first input unit (20) is formed at least substantially rectangular and/or d) wherein the first input unit (20) comprises sensor keys with a display.

8. Glass ceramic hob (22) with an interaction device (1) according to claim 1, a) wherein the interaction device (1) is arranged in a side and/or edge area of the glass ceramic hob and/or arranged at the lower surface of the glass ceramic hob (22) and/or b) wherein the glass ceramic hob comprises a fan for ventilation.

9. Method for protection of the first input unit according to claim 1, comprising the steps of:

a) detecting an input by the second input unit after a preselected threshold value has been exceeded, b) comparing the input value with at least one preselected threshold value, wherein the at least one threshold value is larger than a threshold value generated by the press or the touch of a finger, c) after exceeding the at least one threshold value, c1) turning off the first input unit (20) and/or c2) turning off the heating energy for the glass ceramic hob to decrease the temperature and/or c3) generating an alarm to warn the operator and/or c4) increasing the speed of the fan to decrease the temperature.

10. Method for protection according to claim 9, further comprising the step of detecting by the second input unit when an item is on or close to a defined area.

11. Interaction device according to claim 1, wherein the first sensitive surface is a touch display.

12. Interaction device according to claim 4, wherein the alarm is an acoustical and/or optical alarm.

13. Interaction device according to claim 5, wherein the items are metal objects, pots, pans, grills, forks, spoons, knifes, cookware, water, milk and/or damp clothes.

14. Interaction device according to claim 7, wherein the metal is one of aluminum, copper or nickel.

15. Interaction device according to claim 7, wherein the metal is a capacitive sensor unit.

16. Interaction device according to claim 7, wherein the display is an LED-display, an LCD display or a TFT-display.

17. Glass ceramic hob according to claim 8, wherein the glass ceramic hob is an induction cooking hob.

* * * * *

UNITED STATES PATENT AND TRADEMARK OFFICE

CERTIFICATE OF CORRECTION

PATENT NO. : 8,981,944 B2
APPLICATION NO. : 12/989812
DATED : March 17, 2015
INVENTOR(S) : Laurent Jeanneteau It is certified that error appears in the above-identified patent and that said Letters Patent is hereby corrected as shown below:

In the claims, column 5, claim 4, line 15, please replace "alarm, generable" with -- alarm is generable --

Signed and Sealed this
Fifth Day of July, 2016

Michelle K. Lee

Michelle K. Lee
*Director of the United States Patent and Trademark Office*